US006453515B1

(12) United States Patent
Breuer

(10) Patent No.: US 6,453,515 B1
(45) **Date of Patent: *Sep. 24, 2002**

(54) APPARATUS FOR MEASURING THE TENSION OF SILVER RUNNING IN A DRAW FRAME

(75) Inventor: Achim Breuer, Aachen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/988,369

(22) Filed: Nov. 19, 2001

(30) Foreign Application Priority Data

Nov. 21, 2000 (DE) ..... 100 57 699

(51) Int. Cl.[7] ..... D01H 5/32
(52) U.S. Cl. ..... 19/239; 19/150; 19/240
(58) Field of Search ..... 19/236, 237, 238, 19/239, 240, 150, 157

(56) References Cited

U.S. PATENT DOCUMENTS 2,905,976 A * 9/1959 Matthew et al. ..... 19/237
4,075,739 A * 2/1978 Staheli ..... 19/240
4,864,694 A * 9/1989 Konig et al. ..... 19/27
5,461,757 A * 10/1995 Leifeld ..... 19/150
5,490,308 A * 2/1996 Huber et al. ..... 19/239
5,815,889 A * 10/1998 Barth et al. ..... 19/236
6,170,125 B1 * 1/2001 Steinert et al. ..... 19/150
6,292,982 B1 * 9/2001 Breuer ..... 19/239

FOREIGN PATENT DOCUMENTS

| | | |
|---|---|---|
| DE | 198 09 875 | 9/1999 |
| DE | 199 06 139 | 8/2000 |
| EP | 0 477 589 | 4/1992 |

* cited by examiner

*Primary Examiner*—Danny Worrell
*Assistant Examiner*—Gary L. Welch
(74) *Attorney, Agent, or Firm*—Venable; Gabor J. Kelemen

(57) ABSTRACT

A draw frame includes a transport roll pair for simultaneously guiding a plurality of slivers running in an advancing direction; and a series of drafting roll pairs spaced from one another in the advancing direction. One of the drafting roll pairs is a first drafting roll pair as viewed in the advancing direction. The first drafting roll pair is positioned downstream of the transport roll pair. A measuring device is contacted by the running slivers and includes a pressure-sensitive member exposed to a force derived from the running slivers for emitting a signal representing the force; and a deflecting arrangement for deflecting the running slivers for causing them to be partially trained about the deflecting arrangement to exert on the pressure-sensitive member a pressing force proportional to a tension of the slivers prevailing upstream and downstream of the pressure-sensitive member.

17 Claims, 3 Drawing Sheets

Fig. 2a
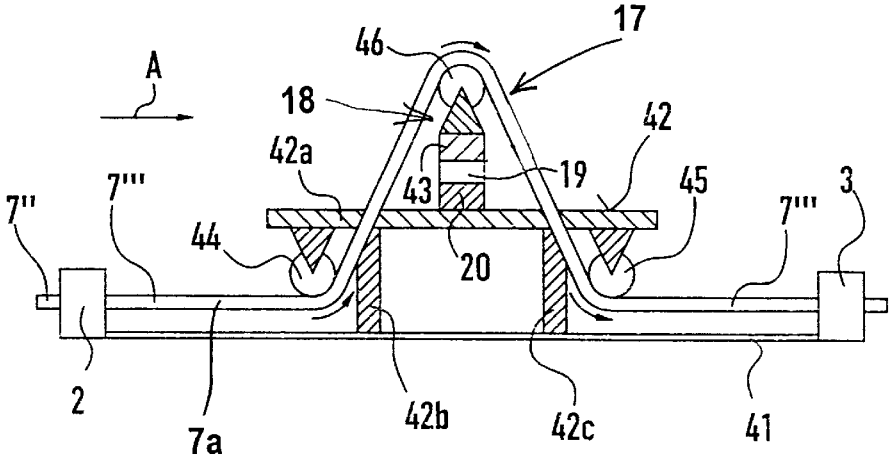
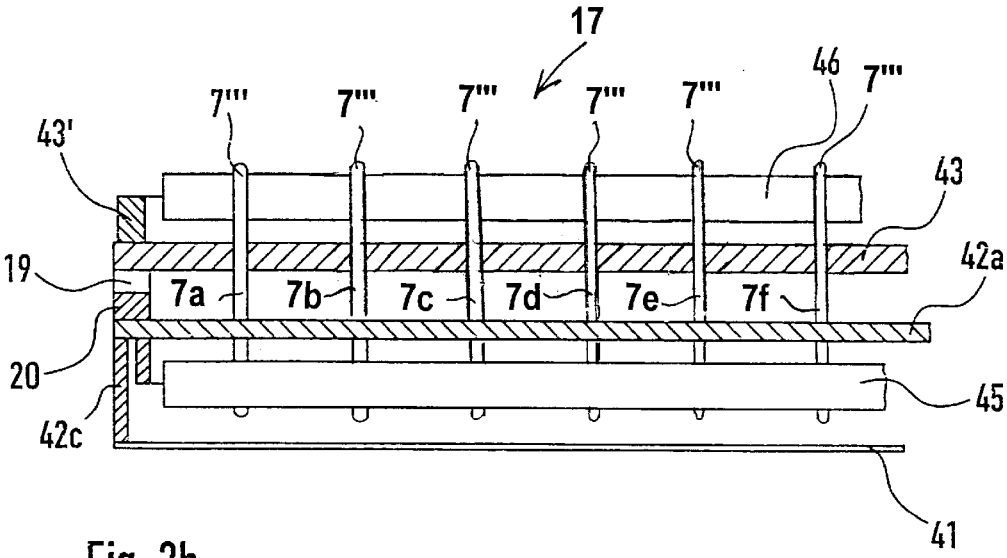
Fig. 2b

APPARATUS FOR MEASURING THE TENSION OF SILVER RUNNING IN A DRAW FRAME

CROSS REFERENCE TO RELATED APPLICATION

This application claims the priority of German Application No. 100 57 699.0 filed Nov. 21, 2000, which is incorporated herein by reference.

BACKGROUND OF THE INVENTION

This invention relates to an apparatus for measuring the tension of sliver composed of cotton fibers, chemical fibers or the like, as it runs in a draw frame. Upstream of the draw frame a creel is situated below which coiler cans are positioned from which sliver is withdrawn. Downstream of the creel, as viewed in the direction of sliver advance, a rider roll assembly and a sliver guide with transporting rolls are provided, followed downstream by input rolls of the draw unit of the draw frame. The slivers running into the draw frame from the coiler cans are in a tensioned condition at least in the zone between the transport rolls and the input rolls of the draw unit.

The sliver tension effected by the transport rolls is derived from the ratio of the circumferential speed of the lower input roll of the draw unit to the circumferential speed of the transport rolls. A setting of the transport roll tension is feasible by means of the transmission gearing associated with the transport rolls. The transport roll tension should be set in such a manner that the slivers between the transport rolls and the lower input roll of the draw unit run with the smallest possible tension which still ensures that the slivers do not undulate as they run on the sliver guide table. Further, when setting the tension, it should be taken into consideration that a satisfactory spread of the sliver is ensured. The tension setting is based on a table in which the different transmission gears are associated with a respective transport roll tension; such table is based empirically for different fiber materials. For the same transmission gear a different transport roll tension may result in case an assortment (fiber lot) change occurs. In practice, the run of the slivers is visually observed and based on such observation, an appropriate transmission gear is selected. In addition, the quality of the drafted sliver at the output of the draw unit is taken into consideration.

It is a disadvantage of the above-outlined conventional arrangement that the tension setting requires substantial experience and does not make possible a precise determination of the transport roll tension.

SUMMARY OF THE INVENTION

It is an object of the invention to provide an improved apparatus of the above-outlined type from which the discussed disadvantages are eliminated and which, in particular, makes possible a precise determination of the transport roll tension and a setting for different fiber lots.

This object and others to become apparent as the specification progresses, are accomplished by the invention, according to which, briefly stated, the draw frame includes a transport roll pair for simultaneously guiding a plurality of slivers running in an advancing direction; and a series of drafting roll pairs spaced from one another in the advancing direction. One of the drafting roll pairs is a first drafting roll pair as viewed in the advancing direction. The first drafting roll pair is positioned downstream of the transport roll pair.

A measuring device is contacted by the running slivers and includes a pressure-sensitive member exposed to a force derived from the running slivers for emitting,a signal representing the force; and a deflecting arrangement for deflecting the running slivers for causing them to be partially trained about the deflecting arrangement to exert to the pressure-sensitive member a pressing force proportional to a tension of the slivers prevailing upstream and downstream of the pressure-sensitive member.

The measures according to the invention make possible a precise determination particularly of the transport roll tension and thus provide for an optimal setting of such tension even in case of a fiber lot change. In this manner, tension values are determined for the most important materials. Therefore, the actual measured value for the tension draft may be compared with the determined, desired value and the machine operator may receive an indication whether the correct tension values have been selected.

BRIEF DESCRIPTION OF THE DRAWINGS

FIG. 2*a* is a sectional side elevational view of a preferred embodiment of the invention.

FIG. 2*b* is a fragmentary sectional front elevational view of the construction shown in FIG. 2*a*.

DESCRIPTION OF THE PREFERRED EMBODIMENTS

Figure 1A:
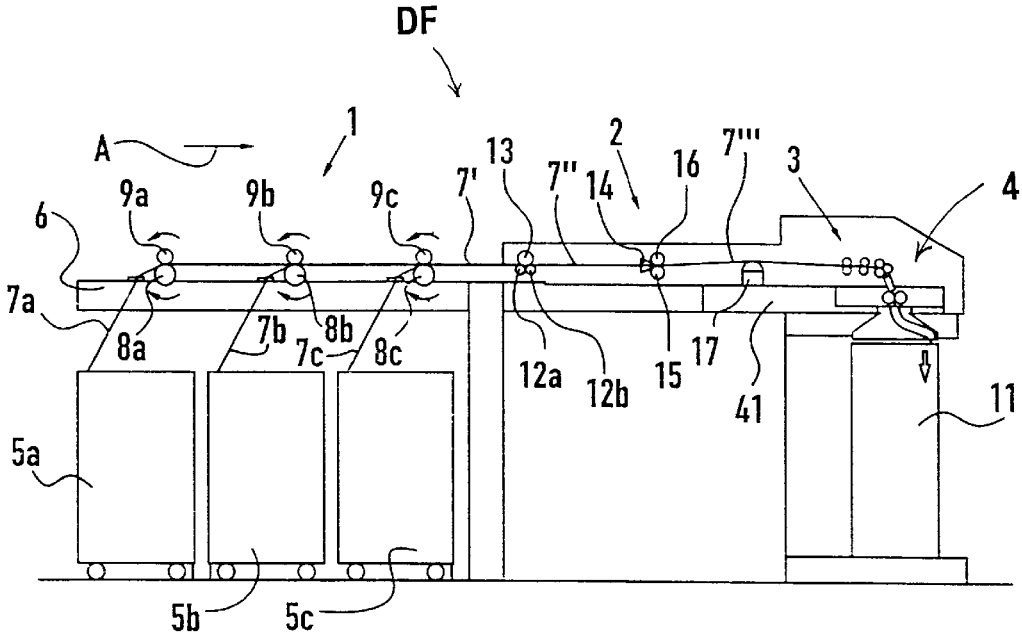
FIG. 1*a* is a schematic side elevational view of a draw frame incorporating the invention.
Figure 1B:
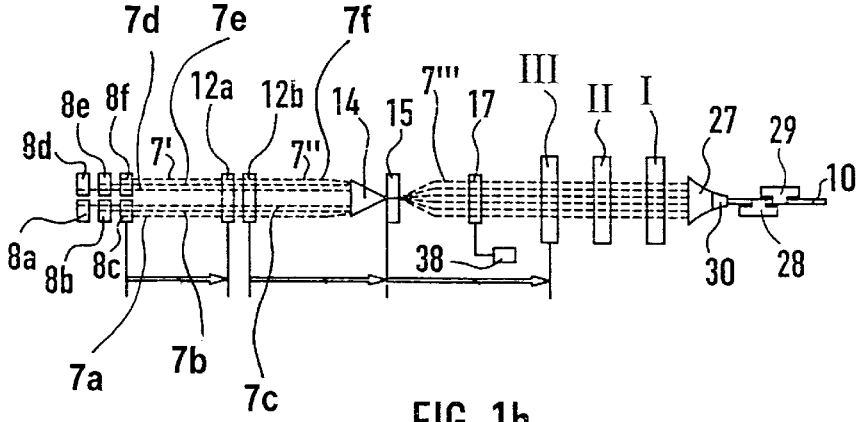
FIG. 1*b* is a partial, schematic top plan view of the construction shown in FIG. 1*a*.

FIG. 1*a* shows a draw frame DF which may be an HSR model manufactured by Trützschler GmbH & Co. KG, M önchengladbach, Germany. The draw frame has an input region 1, a measuring region 2, a draw unit 3 and a sliver coiling unit 4. In the input region 1 two side-by-side extending rows of coiler cans are arranged, of which one row of three coiler cans 5*a*, 5*b* and 5*c* are shown underneath a creel 6. The slivers 7*a*, 7*b* and 7*c* withdrawn from the respective coiler cans are guided by supply rolls 8*a*, 8*b* and 8*c* and introduced into the draw unit 3. Each driven supply roll 8*a*, 8*b* and 8*c* is associated with a respective upper roll 9*a*, 9*b* and 9*c* co-rotating with the supply rolls. As shown in FIG. 1*b*, the second row of coiler cans (not visible in FIG. 1*a*) is associated with additional supply rolls 8*d*, 8*e* and 8*f*, each cooperating with a respective, non-illustrated upper roll similar to the rolls 9*a*–9*c*. The six slivers 7*a*–7*f* withdrawn from the coiler cans are guided to the draw frame proper along the creel 6.

After the slivers have been drawn and combined into a single drafted sliver 10 in the draw unit 3, the sliver 10 is deposited in coils into a receiving coiler can 11 by a rotary head of the coiler unit 4.

In the region underneath each roll pair 8*a*, 9*a*, etc. which crush the respective slivers 7*a*–7*f*, a non-illustrated guide for each sliver is provided. The advancing direction of the slivers is designated at A. Particularly at high withdrawing speeds the slivers balloon and swing above the coiler cans. The slivers are quieted after passing the supply rolls 8*a*–8*f*. Downstream of the creel 6, at the input of the draw frame a driven roll assembly is provided which is composed, for example, of two lower rider rolls 12*a*, 12*b* and three upper rider rolls 13. Each supply roll 8*a*–8*f* is connected to a drive.

Figure 4:
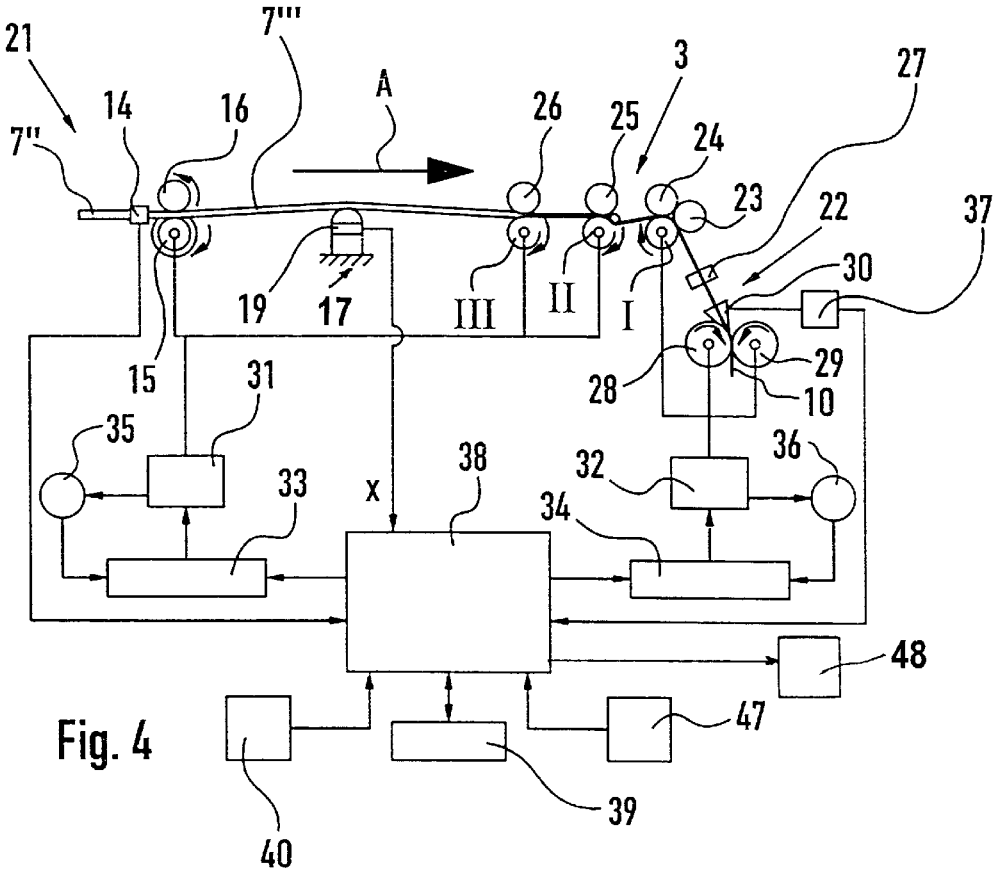
FIG. 4 is a schematic side elevational view of a draw unit, incorporating the embodiment of FIG. 3 and showing a block diagram of the electronic draw frame control.

With reference to FIGS. 1*a*, 1*b* and 4, in the draw unit 3 the length portion 7''' of the slivers 7*a*–7*f* is exposed to the transport roll tension in the region between the cooperating transport rolls 15, 16 and the cooperating input rolls 26, III. The apparatus 17 structured according to the invention is disposed in this region such that the length portions 7''' of the slivers 7*a*–7*f*, as they run in the direction A, press down on the apparatus 17. The length portion 7' of the slivers 7*a*–7*f* extends between the respective supply rolls 8*a*–8*f* on the one hand and the rider rolls 12*a*, 12*b*, 13 on the other hand, while the length portions 7'' of the slivers 7*a*–7*f* extend between rider rolls 12*a*, 12*b*, 13 on the one hand and the cooperating transport rolls 15, 16, on the other hand. The length portions 7', 7'' and 7''' are all exposed to controlled tensions.

The supply rolls 8*a*–8*f* all have the same diameter, for example, 100 mm. The rpm decreases in the working direction A from supply roll to supply roll and is predetermined by a control and regulating device 38. As a result, the circumferential speed of the supply rolls decreases in the working direction A. The circumferential speed of the supply rolls is set such that the tension of the running slivers 7*a*–7*f* has the desired magnitude. The supply rolls 8*a*–8*f* are rotated by non-illustrated drives or transmission mechanisms. The supply rolls 8*a*–8*f* are conventional, two-part constructions. As shown in FIGS. 1*a* and 1*b*, the slivers 7*a*–7*f* run from the creel 6 to the intake region 1 through the rider roll assembly 12, 13, the sliver guide 14 which includes a measuring device with the transport rolls 15, 16, the tension-sensing apparatus 17 (to be described in detail later), the draw unit 3, the sliver guide 27, the sliver trumpet 30 provided with calender rolls 28, 29 and the coiler head which deposits the sliver in the coiler can 11.

FIGS. 2*a* and 2*b* illustrate an embodiment of the apparatus 17 according to the invention. A table-like frame 42 is provided whose plate 42*a* is supported by two legs 42*b*, 42*c* on a fixed machine component 41. In the region of the two ends of the plate 42*a* two rotary deflecting rollers 44 and 45 are arranged in a series as viewed in the working direction A. On the upper face of the plate 42*a* a support element 20 is secured which holds a small-displacement measuring member 19, for example, a piezoelectric element which functions as a force take-up device. Opposite the supporting element 20 the measuring element 19 cooperates with a frame-like pressing element 18 composed of a supporting element 43 contacting the measuring member 19 and a rotary deflecting roller 46 secured to the upper region of the supporting element 43. The length portions 7''' of the slivers 7*a*–7*f* emerging from the transporting rolls 15, 16 are deflected, as they run underneath a deflecting roller 44, from a horizontal position to proceed upwardly at an oblique angle to the deflecting roller 46 and then, running above the deflecting roller 46, the slivers are deflected at an angle to proceed downwardly to a deflecting roller 45 and are, as they run underneath the deflecting roller 45, reoriented into a horizontal direction. The slivers exert, via the deflecting roller 46 and the supporting element 43, a pressing force on the measuring element 19.

In operation, first the frame 42 is set on the draw frame cover 41 so that the length portions 7''' of the slivers 7*a*–7*f* remain unaffected. Thereafter the frame-like supporting element 43 is passed within the frame 42 under the length portions 7''' and above the force take-up device 19 and is positioned and immobilized on the frame 42. The measuring process may be activated when the intended delivery speed is reached. To eliminate the effect of the free sliver length, the weight of the input portion of the sliver and the loop-around friction, the slivers are deflected by the rotatable rollers 44, 45 and 46 and thus the length of the raised sliver portion is defined. The extent of draft and the output number of the input weight are known data inputted into the control device, so that the sliver weight may be subtracted from the tensioning force.

Figure 3:
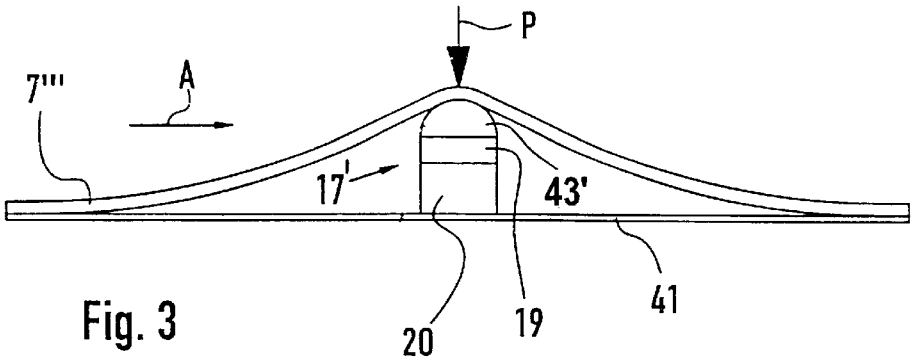
FIG. 3 is a side elevational view of another preferred embodiment of the invention.

According to the embodiment of the sensor device 17' shown in FIG. 3, a supporting element 43' has a rounded upper face directly engaged by the running sliver which, due to its tensioned state, presses down with a force P on the measuring member 19 counter-supported by the supporting element 20 secured to the machine frame 41. The measuring member 19 is disposed between the support element 20 and the pressing element 18. This embodiment is void of deflecting rollers which characterize the embodiment of FIGS. 2*a* and 2*b*. The device 17' is inserted underneath the sliver and the measuring process may be activated when the intended delivery speed is reached.

While the tension-sensing device 17 or 17' was described as being positioned to contact the sliver length portions 7''' between the transport rollers 15, 16 and the input drafting roll pair 26,III, it is to be understood that instead or additionally, the tension sensing device 17 or 17' may be disposed between the supply rolls 8*a*–8*f* on the creel 6 and the rider rolls 12*a*, 12*b*, 13 to contact the sliver length portions 7' and/or between the rider rolls 12*a*, 12*b*, 13 and the transport rolls 15, 16 to contact the sliver length portions 7''.

Turning to FIG. 4, the draw unit 3 of the draw frame has an input 21 and an output 22. The length portions 7'' of the slivers 7*a*–7*f* are moved through the measuring member 14 as they are pulled by the transport rolls 15, 16.

The draw unit 3, in which the drafting of the slivers occurs, is a 4-over-3 construction, that is, it has a lower output roll I, a lower middle roll II and a lower input roll III as well as four upper rolls 23, 24, 25 and 26. The draft is composed of a preliminary and principal draft. The roll pairs 26, III and 25, II constitute the preliminary drafting field whereas the roll pair 25, II and the roll assembly 23, 24, I constitute the principal drafting field. The drafted slivers reach, at the draw unit output 22, a sliver guide 27 and are, by means of calender rolls 28, 29, pulled through a sliver trumpet 30 in which the slivers 7*a*–7*f* are combined into a single sliver 10 which is subsequently deposited in a coiler can 11.

The transport rolls 15, 16, the lower input roll III and the lower mid roll II which are mechanically interconnected, for example, by a toothed belt, are driven by a regulating motor 31 rotated by a desired rpm value which may be inputted. The respective upper rolls 26 and 25 are driven by friction by their respective lower rolls. The lower output roll I and the calender rolls 28, 29 are driven by a main motor 32. The regulating motor 31 and the main motor 32 are provided with a respective regulator 33 and 34. The rpm regulation occurs by means of a closed regulating circuit in which tachogenerators 35 and 36 are connected with the regulating motor 31 and the main motor 32, respectively. At the draw unit input 21 a mass-proportionate magnitude, for example, the cross section of the slivers is measured by the input measuring organ 14. At the draw unit output 22 the cross section of the exiting sliver 10 is measured by an output measuring member 37 integrated in a sliver trumpet 30.

A central computer unit 38 (control and regulating device), for example, a microcomputer with microprocessor, transmits a setting of the desired value to the regulator 33 for the regulating motor 31. The measured values of the measuring organ 14 are transmitted to the central unit 38 during the drafting process. From the measured magnitudes determined by the measuring organ 14 and from the desired value for the cross section of the exiting sliver 10, the central unit 38 determines the setting value for the regulating motor 31. The measured values determined by the output measuring member 37 serve for monitoring the discharged sliver 10. With the aid of such a regulating system fluctuations in the cross section of the inputted slivers are compensated for by means of a suitable regulation of the drafting process and thus an evening of the sliver 10 may be achieved. 39 designates an inputting device and 40 designates schematically the drive for the supply rolls 8*a*–8*f*. The measuring element 19 of the measuring device 17 is also connected with the control and regulating device 38 to receive, from the measuring device 17, electric signals x which represent the pressure which the running sliver exerts on the measuring element 19. Such a pressure is a function of the tension of the running sliver upstream and downstream of the measuring device 17. In the control and regulating device 38 the tension force exerted on the running sliver is computed from the signals x. The resulting signals are stored in a memory 47. In this manner tension values for the most important materials are stored. As a result, the actual measured tension value may be compared with the inputted tension values and thus the machine operator may receive an indication whether the correct tension values were selected. A display device 48 is connected to the control and regulating device 38 for displaying the sliver tension detected by the measuring device 17.

It will be understood that the above description of the present invention is susceptible to various modifications, changes and adaptations, and the same are intended to be comprehended within the meaning and range of equivalents of the appended claims.

What is claimed is:

1. A draw frame comprising (a) a transport roll pair for simultaneously guiding a plurality of slivers running in an advancing direction;

(b) a series of drafting roll pairs spaced from one another in said advancing direction; one of said drafting roll pairs being a first drafting roll pair as viewed in said advancing direction; said first drafting roll pair being positioned downstream of said transport roll pair; and (c) a measuring device contacting the running slivers; said measuring device including (1) a pressure-sensitive member exposed to a force derived from the running slivers for emitting a signal representing said force; and (2) deflecting means for deflecting the running slivers for causing the running slivers to be partially trained about said deflecting means to exert on said pressure-sensitive member a pressing force proportional to a tension of the slivers prevailing upstream and downstream of said pressure-sensitive member.

2. The draw frame as defined in claim 1, wherein said pressure-sensitive member comprises a piezoelectric element.

3. The draw frame as defined in claim 1, wherein said pressure-sensitive member is rigidly supported on a stationary component.

4. The draw frame as defined in claim 1, wherein said measuring device is disposed between said transport roll pair and said first drafting roll pair.

5. The draw frame as defined in claim 1, further comprising rider rolls over which the slivers pass; said rider rolls being arranged upstream of said transport rolls; a creel; supply rolls mounted on said creel for advancing the slivers; said supply rolls being spaced from said rider rolls upstream thereof; said measuring device being disposed between said rider rolls and said supply rolls.

6. The draw frame as defined in claim 1, wherein said measuring device is disposed upstream of said transport roll pair.

7. The draw frame as defined in claim 6, further comprising rider rolls over which the slivers pass; said rider rolls being arranged upstream of said transport rolls; said measuring device being disposed between said transport rolls and said rider rolls.

8. The draw frame as defined in claim 1, further comprising a computer for controlling the draw frame operation; said measuring device being connected to said computer for applying said signal to said computer.

9. The draw frame as defined in claim 8, further comprising a display device connected to said computer for displaying the tension of said slivers based on said signal.

10. The draw frame as defined in claim 1, further comprising a pressing element for transmitting the pressing force from said slivers to said pressure-sensitive member.

11. The draw frame as defined in claim 10, wherein said pressing element is stationarily supported.

12. The draw frame as defined in claim 10, wherein said pressing element and said pressure-sensitive member are rigidly connected to one another.

13. The draw frame as defined in claim 10, further comprising a bar extending perpendicularly to said running direction and being positioned on said pressure-sensitive member, said bar constituting said deflecting means and said pressing element.

14. The draw frame as defined in claim 10, wherein said deflecting means includes a roller mounted on said pressing element.

15. The draw frame as defined in claim 14, wherein said roller is a first roller; said deflecting means further including a second roller supported upstream of said first roller for deflecting the running slivers toward said first roller and a third roller supported downstream of said first roller; said first roller deflecting the slivers toward said third roller.

16. The draw frame as defined in claim 15, wherein said measuring device comprises a stationarily supported frame; said second and third rollers being carried by said frame; a first bar supported on said frame and extending perpendicularly to said running direction; said pressure-sensitive element being supported on said first bar; a second bar extending parallel to said first bar and being supported on said pressure-sensitive element; said second bar constituting said pressing element; said second bar supporting said first roller.

17. The draw frame as defined in claim 15, wherein said first, second and third rollers are idlers and are rotatable by the running slivers by friction.

* * * * *

UNITED STATES PATENT AND TRADEMARK OFFICE

CERTIFICATE OF CORRECTION

PATENT NO. : 6,453,515 B1
DATED : September 24, 2002
INVENTOR(S) : Achim Breuer

It is certified that error appears in the above-identified patent and that said Letters Patent is hereby corrected as shown below:

Title page,
Item [54], should read -- [54]: APPARATUS FOR MEASURING THE TENSION OF SLIVER RUNNING IN A DRAW FRAME --

Signed and Sealed this

Twenty-eighth Day of January, 2003

JAMES E. ROGAN
*Director of the United States Patent and Trademark Office*